US010239109B2

(12) United States Patent
Carstens et al.

(10) Patent No.: US 10,239,109 B2
(45) Date of Patent: Mar. 26, 2019

(54) SHELL SYSTEM LOCATING ASSEMBLY FOR SHELLS

(71) Applicant: Stolle Machinery Company, LLC, Centennial, CO (US)

(72) Inventors: Aaron Emmanuel Carstens, Centerville, OH (US); James Ardel McClung, Canton, OH (US); Paul L. Ripple, Canton, OH (US); Edward E. Donaldson, North Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 586 days.

(21) Appl. No.: 15/057,567

(22) Filed: Mar. 1, 2016

(65) Prior Publication Data

US 2017/0252793 A1 Sep. 7, 2017

(51) Int. Cl.

| | |
|---|---|
| ***B21D 43/12*** | (2006.01) |
| ***B21D 51/38*** | (2006.01) |
| ***B21D 43/05*** | (2006.01) |
| ***B21D 51/26*** | (2006.01) |
| ***B21D 19/12*** | (2006.01) |
| ***B21D 51/44*** | (2006.01) |

(52) U.S. Cl.

CPC ..... *B21D 43/12* (2013.01); *B21D 19/12* (2013.01); *B21D 43/05* (2013.01); *B21D 51/2615* (2013.01); *B21D 51/383* (2013.01); *B21D 51/44* (2013.01); *B21D 51/443* (2013.01)

(58) Field of Classification Search

CPC ..... B21D 43/12; B21D 51/383; B21D 19/12; B21D 43/05; B21D 51/44; B21D 51/443; B21D 51/2615

USPC ..... 72/422

See application file for complete search history.

(56) References Cited

U.S. PATENT DOCUMENTS

| | | | | |
|---|---|---|---|---|
| 4,627,264 A | | 12/1986 | Grow et al. | |
| 4,799,846 A | * | 1/1989 | Wissman | B21D 51/383 198/803.15 |
| 4,903,521 A | | 2/1990 | Bulso, Jr. et al. | |
| 4,918,956 A | * | 4/1990 | Schoch | B21D 51/383 72/21.1 |

(Continued)

OTHER PUBLICATIONS

Stolle Machinery Company, LLC, PCT/US2017/017105 International Search Report and Written Opinion, dated Apr. 13, 2017, 7 pages.

*Primary Examiner* — David B Jones

(74) *Attorney, Agent, or Firm* — Eckert Seamans Cherin & Mellott, LLC

(57) ABSTRACT

An alignment assembly for a press assembly is provided. The alignment assembly includes a number of alignment elements. The alignment elements include a number of moving alignment elements. The moving alignment elements are coupled to an upper tooling assembly that moves between a first and second position. As the upper tooling assembly moves, the moving alignment elements move between a first position and a second position corresponding to the upper tooling assembly first position and a second position. The moving alignment elements are structured to move the shell from the initial alignment position to an intermediate alignment position. Thus, as the upper tooling assembly moves from the first position to the second position, the moving alignment elements contact a shell and move the shell from an initial alignment position to an intermediate alignment position.

20 Claims, 7 Drawing Sheets

(56) References Cited

U.S. PATENT DOCUMENTS

| | | | | |
|---|---|---|---|---|
| 5,067,341 | A | 11/1991 | Wynn et al. | |
| 5,158,410 | A | 10/1992 | Hunt | |
| 5,813,513 | A * | 9/1998 | Taube | B21D 43/12 198/803.14 |
| 5,876,171 | A | 3/1999 | Martin et al. | |
| 6,405,853 | B1 * | 6/2002 | Cook | B21D 43/12 198/803.15 |
| 6,695,132 | B2 * | 2/2004 | Cook | B21D 43/12 198/832.1 |
| 6,931,905 | B2 | 8/2005 | Rubalcava et al. | |
| 6,941,651 | B2 * | 9/2005 | Radocaj | B21K 1/42 29/509 |
| 8,061,027 | B2 * | 11/2011 | Garner, Jr. | H01R 43/055 29/566.2 |
| 8,141,694 | B2 * | 3/2012 | Krallinger | B27F 1/06 198/345.1 |
| 2004/0144151 | A1 | 7/2004 | Allen | |
| 2009/0232926 | A1 | 9/2009 | Sofronie et al. | |
| 2010/0263430 | A1 | 10/2010 | Miceli et al. | |
| 2015/0050094 | A1 | 2/2015 | Gerlings | |

* cited by examiner

SHELL SYSTEM LOCATING ASSEMBLY FOR SHELLS

BACKGROUND OF THE INVENTION

Field of the Invention

The disclosed and claimed concept relates to an alignment assembly for a forming machine and, more specifically to an alignment assembly that repositions a shell from an initial alignment position to an intermediate alignment position between an upper tooling assembly and a lower tooling assembly.

Background Information

Metallic containers (e.g., cans) for holding products such as, for example, liquids, beverages, or food products, are typically provided with an easy open can end on which an opening mechanism, such as a pull tab, is attached (e.g., without limitation, riveted) to a tear strip or severable panel. Typically, the tear strip is defined by a scoreline in the exterior surface (e.g., public side) of the can end. The pull tab is structured to be lifted, pulled, and/or rotated to sever the scoreline and deflect the tear strip, thereby creating an opening for dispensing the contents of the can.

When the can end is made, it originates as a can end shell, which is formed from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press. Typically, each tool station of the conversion press includes an upper tool member, which is structured to be advanced towards a lower tool member upon actuation of a press ram. The shell is received between the upper and lower tool members. Thus, as the upper tool member engages the shell, the upper and/or lower tool members respectively act upon the public (e.g., exterior side) and/or product (e.g., interior side, which faces the can body) sides of the shell, in order to perform a number of the aforementioned conversion operations. Upon completion of a given operation, the press ram retracts the upper tool member and the partially converted shell is moved to the next successive tool station, or the tooling assembly is changed within the same station, to perform the next conversion operation.

More specifically, a press assembly includes an operating mechanism, a transfer belt, and a tooling assembly. The tooling assembly includes an upper tooling assembly and a lower tooling assembly. In an exemplary embodiment, at each station the upper tooling assembly includes a forming construct such as, but not limited to, a punch. Similarly, at each station the lower tooling assembly includes a cooperative forming construct such as, but not limited to, a die. The shells are moved intermittently, or as used herein, "indexed," through the tooling assembly thereby stopping at each station. That is, the operating mechanism is structured to operatively engage the transfer belt and the tooling assembly, essentially, alternately. Such an apparatus is disclosed in U.S. Pat. No. 4,903,521.

The transfer belt is structured to index a number of shells through the tooling assembly. In an exemplary embodiment, the transfer belt includes a number of apertures into which a blank is deposited. As noted above, the upper tooling assembly and the lower tooling assembly are structured to move between a first position, wherein the upper tooling assembly and the lower tooling assembly are spaced, and a second position wherein the upper tooling assembly and the lower tooling assembly are disposed immediately adjacent each other. It is common for one tooling assembly to be stationary and for the other tooling assembly to move. In an exemplary embodiment, and as used herein, the upper tooling assembly is described as the tooling assembly that moves while the lower tooling assembly is described as the stationary tooling assembly. When the upper tooling assembly and the lower tooling assembly are not in the second position, the operating mechanism operatively engages the transfer belt to move each shell to the next station. The transfer belt positions each shell in an initial alignment position at a station between the upper tooling assembly and the lower tooling assembly. When the shells are in the initial alignment position at a station between the upper tooling assembly and the lower tooling assembly, the operating mechanism operatively engages the upper tooling assembly and moves the upper tooling assembly to the second position. During this operation, the forming operations as described above occur.

Part of the forming operations may include moving the shell to a final alignment position. That is, a shell in the initial alignment position is often not properly aligned with the forming constructs of the station. Accordingly, the tooling assembly, and more specifically each station, may include a final alignment assembly that is structured to position the shell in the final alignment position. In an exemplary embodiment, a final alignment assembly includes an angled surface on the upper tooling assembly. As the upper tooling assembly moves toward the second position, the angled surface on the upper tooling assembly operatively engages the shell and moves the shell to the final alignment position. Once the shell is in the final alignment position, the forming constructs engage the shell and perform the forming operation(s) of the station.

Such press assemblies have a disadvantage in that a shell in the initial alignment position may be too misaligned to be placed in the final alignment position by known tooling assembly assemblies. By way of example, as the shell is converted from an initial generally planar shape to the final shape, the area of the shell may diminish. That is, a shell begins, in many instances, as a planar member. To accommodate the initial configuration of the shell, the apertures in the transfer belt must have a shape that corresponds to the shape of the planar shell. That is, the size and shape of the apertures in the transfer belt substantially correspond to the size and shape of the initial size and shape of the shell. Forming operations on the shell, such as, but not limited to, forming a curled perimeter on the shell, cause the size and the shape of the shell to change and often results in the shell having a smaller area. Moreover, the indexing, i.e., rapidly starting and stopping the transfer belt, cause a shell to move within the transfer belt apertures. That is, the shells may be displaced forwardly, rearwardly, laterally, or askew, i.e., angularly offset, in the transfer belt apertures.

There is, therefore, a need for an alignment assembly that repositions a shell from an initial alignment position to an intermediate alignment position between an upper tooling assembly and a lower tooling assembly. There is a further need for an alignment assembly that may be incorporated into existing press assemblies.

SUMMARY OF THE INVENTION

These needs, and others, are met by at least one embodiment of this invention which provides an alignment assembly for a press assembly including a number of alignment elements. The alignment elements include a number of moving alignment elements. The moving alignment elements are coupled to an upper tooling assembly that move between a first and second position. As the upper tooling assembly moves, the moving alignment elements move between a first position and a second position corresponding to the upper tooling assembly first position and a second position. The moving alignment elements are structured to move the shell from the initial alignment position to an intermediate alignment position. Thus, as the upper tooling assembly moves from the first position to the second position, the moving alignment elements contact a shell and move the shell from an initial alignment position to an intermediate alignment position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
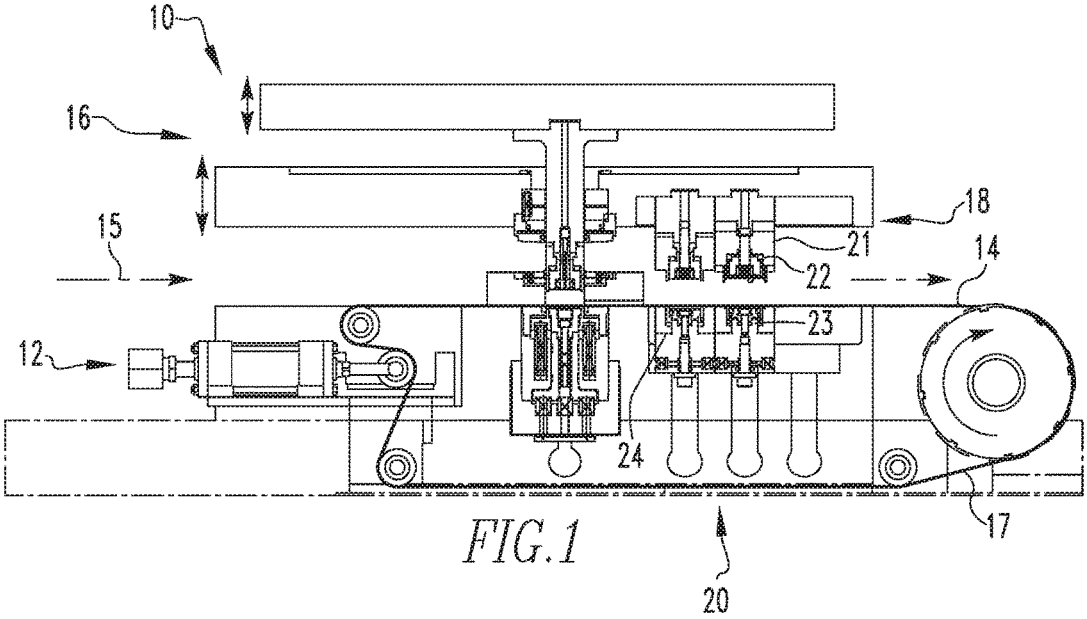
FIG. 1 is a schematic view of a press assembly.

For purposes of illustration, embodiments of the disclosed concept will be described as applied to cans and/or can ends for food, although it will become apparent that they could also be used with other containers such as, for example and without limitation, cans for liquids such, but not limited to, beer and beverages. It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, food cans, as well as beverage cans, such as beer and soda cans.

As used herein, the singular form of "a," "an," and "the" include plural references unless the context clearly dictates otherwise.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component" is one element of a coupling assembly. That is, a coupling assembly includes at least two components, or coupling components, that are structured to be coupled together. It is understood that the elements of a coupling assembly are compatible with each other. For example, in a coupling assembly, if one coupling element is a snap socket, the other coupling element is a snap plug. A "coupling" or "coupling component" includes a passage through which another element, such as but not limited to, a fastener passes.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. It is noted that moving parts may be "directly coupled" when in one position, but may not be "directly coupled" when in another position. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the phrase "removably coupled" means that one component is coupled with another component in an essentially temporary and selectable manner. That is, the two components are coupled in such a way that the joining or separation of the components is easy and would not damage the components. For example, two components secured to each other with a limited number of readily accessible coupling assemblies are "removably coupled" whereas two components that are welded together or joined by difficult to access fasteners are not "removably coupled." A "difficult to access coupling assembly" is one that requires the removal of one or more other components prior to accessing the coupling assembly wherein the "other component" is not an access device such as, but not limited to, a door. By way of a further example, a clutch in an automobile is selectively coupled to the engine and the transmission, but is not a "removable coupling" in that the clutch is encased in a housing and cannot easily be accessed. Further, to be "removably coupled," no coupling assemblies linking the two elements can be a "difficult to access coupling assembly." That is, two elements coupled by many easy to access couplings and a single "difficult to access" fastener are not "removable coupled."

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, the statement that two or more parts or components "engage" one another shall mean that the parts exert a force against one another either directly or through one or more intermediate parts or components.

As used herein, the word "unitary" means a component is created as a single piece or unit. That is, a component that includes pieces that are created separately and then coupled together as a unit is not a "unitary" component or body.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function.

As used herein, the term "number" shall mean one or an integer greater than one (i.e., a plurality).

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, "progressively advance" or "index" means that a feeder device, conveyor, or other construct used to move work pieces moves a work piece forward a predetermined distance during each cycle of a press. That is, during an "indexing" motion, the conveyor is in motion for a time and is stationary for a time. Stated alternately, during an "indexing" motion there is a motion state and a stationary state of the conveyor.

As used herein, a "path of travel" of an element includes the space an element moves through when in motion. Thus, as used herein, any element that moves inherently has a path of travel.

As used herein, "translate" means to move relative to another element while maintaining the same orientation relative to a distant point.

As used herein, "shell" means a metal work piece that is being formed. The "shell" is formed by stations in the press assembly and, as such, it is understood that the "shell" changes size and shape until a final processing step at which the "shell" becomes a product. In an exemplary embodiment, the "shell" is a generally planar construct that is processed to become a "can end" upon a final processing step. This exemplary "shell" has various forming operations performed thereto that create, among other features, a curled edge that is used to couple the lid to a container body. It is understood, however, that a "shell" may be any type of metal work piece including containers and can bodies.

As used herein, "can end" refers to the lid or closure that is structured to be coupled to a can, in order to seal the can.

In an exemplary embodiment, and as shown in FIG. 1, a press assembly 10 is structured to can ends 2. Generally, the press assembly 10 includes an operating mechanism 12, a transfer belt 14, and a tooling assembly 16. The tooling assembly 16 includes an upper tooling assembly 18 and a lower tooling assembly 20. As is known, each tooling assembly 18, 20 includes a number of stations (not shown), each of which performs a different forming operation. Further, each tooling assembly 18, 20 may include a number of lanes (not shown) so that multiple shells may be formed into can ends simultaneously. In an exemplary embodiment, at each station the upper tooling assembly 18 includes an upper forming construct 21 such as, but not limited to, a punch 22, which performs a curl forming operation. Similarly, at each station the lower tooling assembly 20 includes a cooperative lower forming construct 23 such as, but not limited to, a die 24. As is known, the upper tooling assembly 18 moves between a first position, wherein the upper tooling assembly 18 is spaced from the lower tooling assembly 20, and a second position, wherein the upper tooling assembly 18 is immediately adjacent the lower tooling assembly 20.

Figure 2:
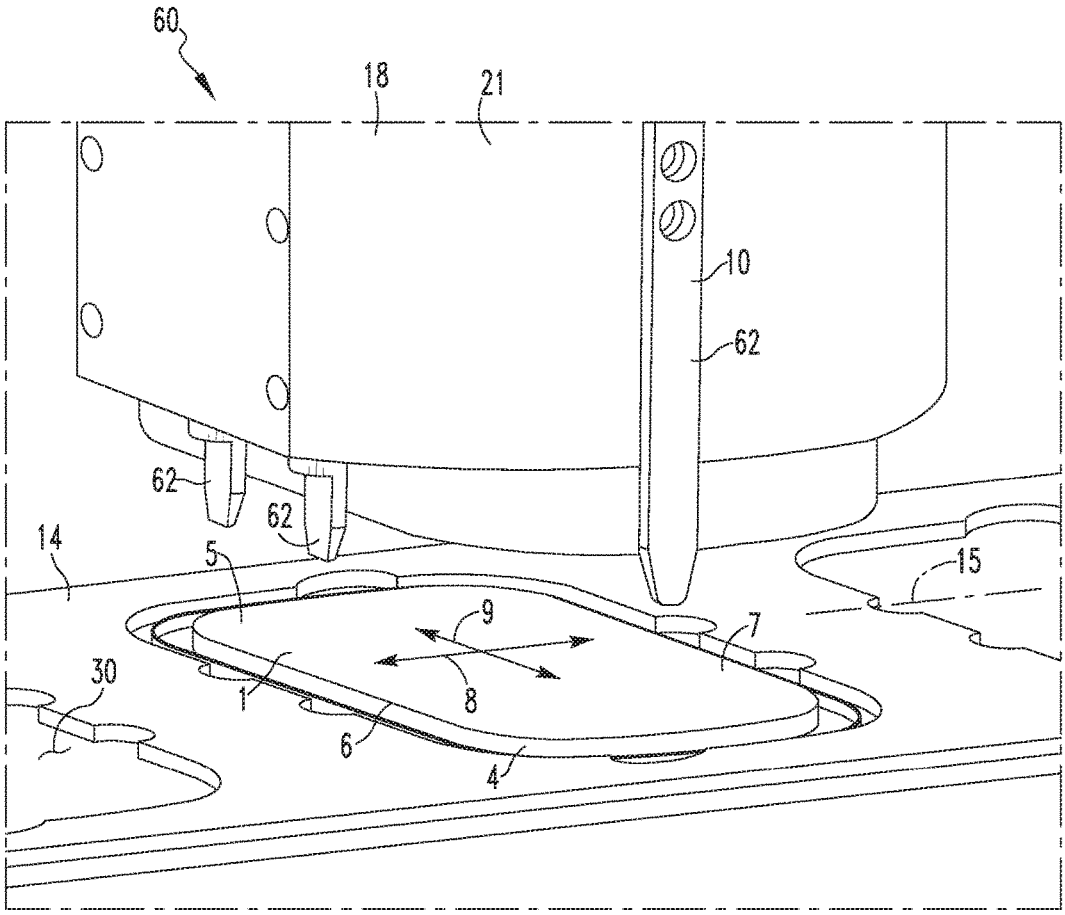
FIG. 2 is an isometric view of a transfer belt and an upper forming construct.

The transfer belt 14 is a belt disposed in a conveyor configuration, i.e., a loop, and, as shown in FIG. 2, includes a number of substantially evenly spaced apertures 30. The transfer belt 14 extends through the press assembly 10, i.e., between the upper tooling assembly 18 and the lower tooling assembly 20. As is known, the transfer belt 14 is driven by a drive assembly (not shown) and, as used herein, moves forwardly in a longitudinal direction along a transfer belt longitudinal axis 15 through the press assembly 10. It is understood that the return portion of the transfer belt 14, which does not transport shells 1 (as discussed below), travels in the opposite direction. In an exemplary embodiment, the transfer belt 14 includes a flexible, generally planar body 17 that is formed into a loop. As is known, a blank, or the preliminary form of the shell 1, is disposed in a transfer belt aperture 30 and is progressively advanced, or indexed, through the press assembly 10. That is, as the transfer belt 14 indexes, a shell 1 is moved sequentially through the various stations with a different forming operation performed at each station. Generally, the transfer belt 14 moves when the upper tooling assembly 18 is not in the second position, i.e. as the upper tooling assembly is moving toward the first position, when the upper tooling assembly is in the first position and/or when the upper tooling assembly first starts to move toward the second position. It is noted that certain press assemblies use a platen, such as, but not limited to a circular platen to move shells through a press assembly. Accordingly, as used herein, a "belt" includes a platen.

The operating mechanism 12 includes a number of drive assemblies (not shown) that are linked mechanically or electronically, or both, with one drive assembly operatively engaging the upper tooling assembly 18 and another drive assembly operatively engaging the transfer belt 14. The operating mechanism 12 is structured to move the upper tooling assembly between the first and second positions and to move the transfer belt 14 as described above. It is understood that the operating mechanism 12 provides a repetitive motion to the other elements. Each time the upper tooling assembly 18 reciprocates, the press assembly 10 completes one cycle. Further, as described above, during each cycle, the transfer belt 14 indexes forward but is not moving as the upper tooling assembly 18 moves into the second position. In this configuration, the press assembly 10 progressively forms a shell 1 into a can end 2.

While it is understood that a tooling assembly 16 includes multiple stations, the following description does not require details of the various stations. Accordingly, the following discussion relates to a single station including an upper cap 22 coupled to the upper tooling assembly 18, and, a die 24 coupled to the lower tooling assembly 20. As discussed above, the upper tooling assembly 18, and therefore the upper cap 22, are operatively engaged by the operating mechanism 12 and reciprocate between an upper, first position, wherein the upper cap 22 is spaced from the die 24, and a lower, second position, wherein the upper cap 22 is immediately adjacent the die 24. It is further understood that the station shown performs forming operations on a shell 1 that has been partially formed by prior stations so that the shape and size of the shell 1 is effectively reduced relative to the shape and size of the transfer belt aperture 30.

That is, it is understood that the size and shape of a shell 1 changes as the shell 1 is formed into a can end 2. Generally, the size and shape of a shell 1 becomes smaller as portions thereof are formed into shapes such as, but not limited to, an edge curl. That is, in an exemplary embodiment, the shell 1 is initially a substantially planar member that is fed on to the transfer belt 14 by a feeder device (not shown) or cut from a sheet of metal by a cutting station (not shown) while the sheet is disposed over the transfer belt 14. When the shell 1 is initially disposed in a transfer belt aperture 30, the size and shape of the shell 1 and the a transfer belt aperture 30 substantially correspond to each other. Thus, as the transfer belt 14 moves the shell 1 to the first station, the shell 1 is placed in a final alignment position by the transfer belt 14. That is, the transfer belt 14 is structured to move in a manner whereby the shell 1 is disposed in a desired location between the upper tooling assembly 18 and the lower tooling assembly 20. That is, as used herein, the "final alignment position" is the desired position for the shell 1 as forming operations occur within a station. The upper forming construct 21 of the upper tooling assembly 18, in the exemplary embodiment a upper cap 22, includes an angled surface 26. The upper tooling assembly angled surface 26 is disposed at a location so that, as the upper tooling assembly moves into the second position, the upper tooling assembly angled surface 26 operatively engages the shell 1 and moves the shell 1 from an intermediate alignment position (described below) to the final alignment position.

As the shell 1 is further formed, the shape and size of the shell 1 is effectively reduced relative to the shape and size of the transfer belt aperture 30 in which it is disposed. When the shell is in this configuration, movement of the transfer belt 14 causes the shell 1 to move within the transfer belt aperture 30. That is, the shell 1 may be displaced, relative to the final alignment position, forwardly, rearwardly, laterally, or askew, i.e., angularly offset, in the transfer belt aperture 30. As used herein, and when the shell 1 has a reduced shape and size relative to the associated transfer belt aperture 30, the position of a shell 1 following movement of the transfer belt 14 is the "initial alignment position." That is, the "initial alignment position" is not the desired position for the shell as forming operations occur within a station. Further, as used herein, the "initial alignment position" is a position wherein the shell 1 is offset, or otherwise misaligned with the tooling assembly 16 so that an upper tooling angled surface 26 (discussed below and which is an alignment surface) cannot position the shell 1 in the final alignment position. Accordingly, the transfer belt 14 stops moving, i.e., the transfer belt 14 is in the stationary state of the indexing motion, and positions the shells 1 in an initial alignment position.

As shown in FIGS. 2-5, the press assembly 10 further includes an alignment assembly 60 structured to move a shell 1 from an initial alignment position to an "intermediate alignment position." As used herein, an "intermediate alignment position" is a position to which a shell 1 is moved from an initial alignment position and which allows an upper tooling angled surface 26 to move the shell 1 into a final alignment position. It is noted that, as used herein, the "intermediate alignment position" is not the final alignment position.

The alignment assembly 60, in an exemplary embodiment, includes elements on the transfer belt 14, the upper tooling 18 and the lower tooling 20. As shown, the alignment assembly 60 includes number of alignment elements 62. In this exemplary embodiment, the number of alignment elements 62 include a number of moving alignment elements 70, a number of alignment recesses 90, and a number of alignment cavities 110. As used herein, an "alignment element" is a construct that moves a shell 1 from an initial alignment position to an intermediate alignment position, or, elements that are structured to assist or allow other elements to move a shell 1 from an initial alignment position to an intermediate alignment position. That is, as used herein, a recess on a belt aperture 30 that serves a purpose other than allowing a moving alignment element to pass is not an "alignment recess." Similarly, moving element and an associated cavity, for example a rod on a moving die 24 and a cavity on a stationary die, that are structured to align the dies, but that do not directly move a shell 1, i.e., wherein the rods do not directly contact the shell, from an initial alignment position to an intermediate alignment position, are not "alignment elements," as used herein.

Figure 3:
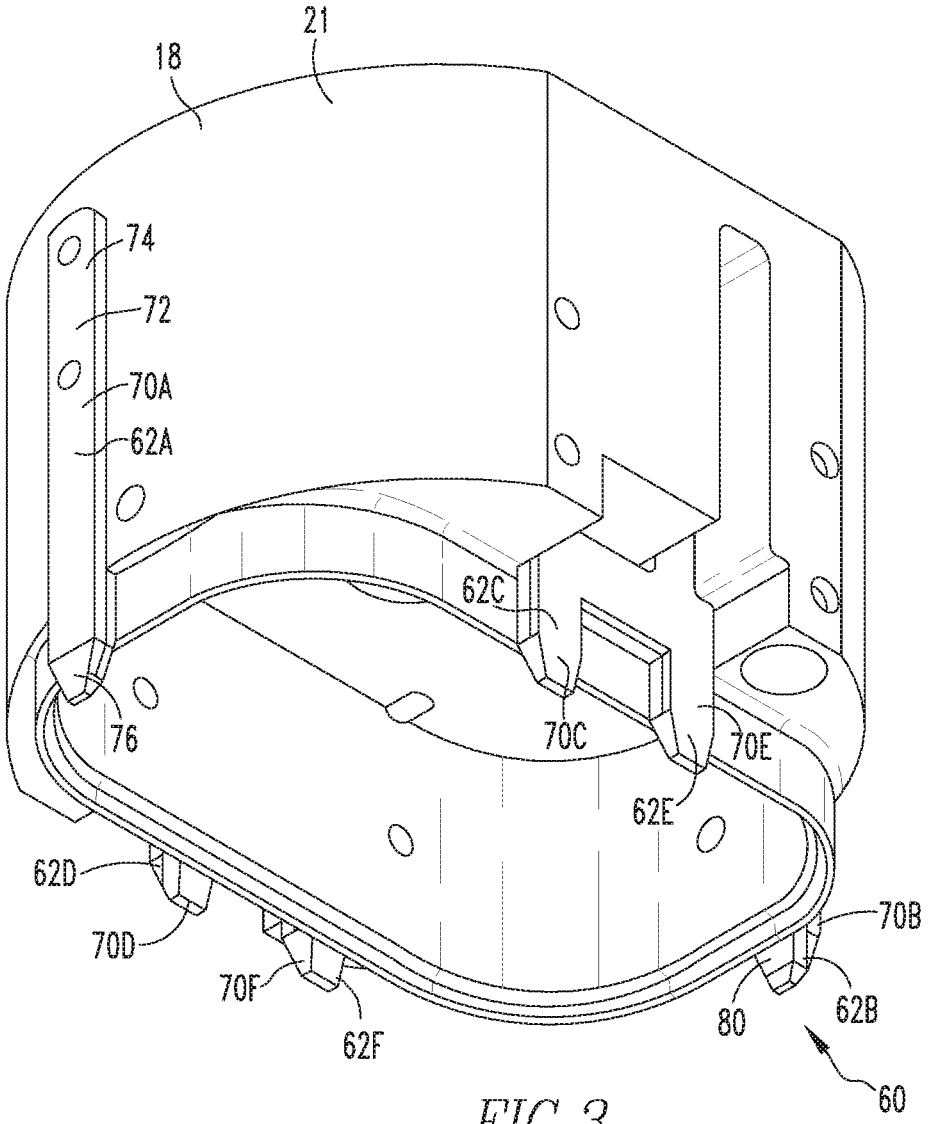
FIG. 3 is an isometric view of an upper forming construct.
Figure 4:
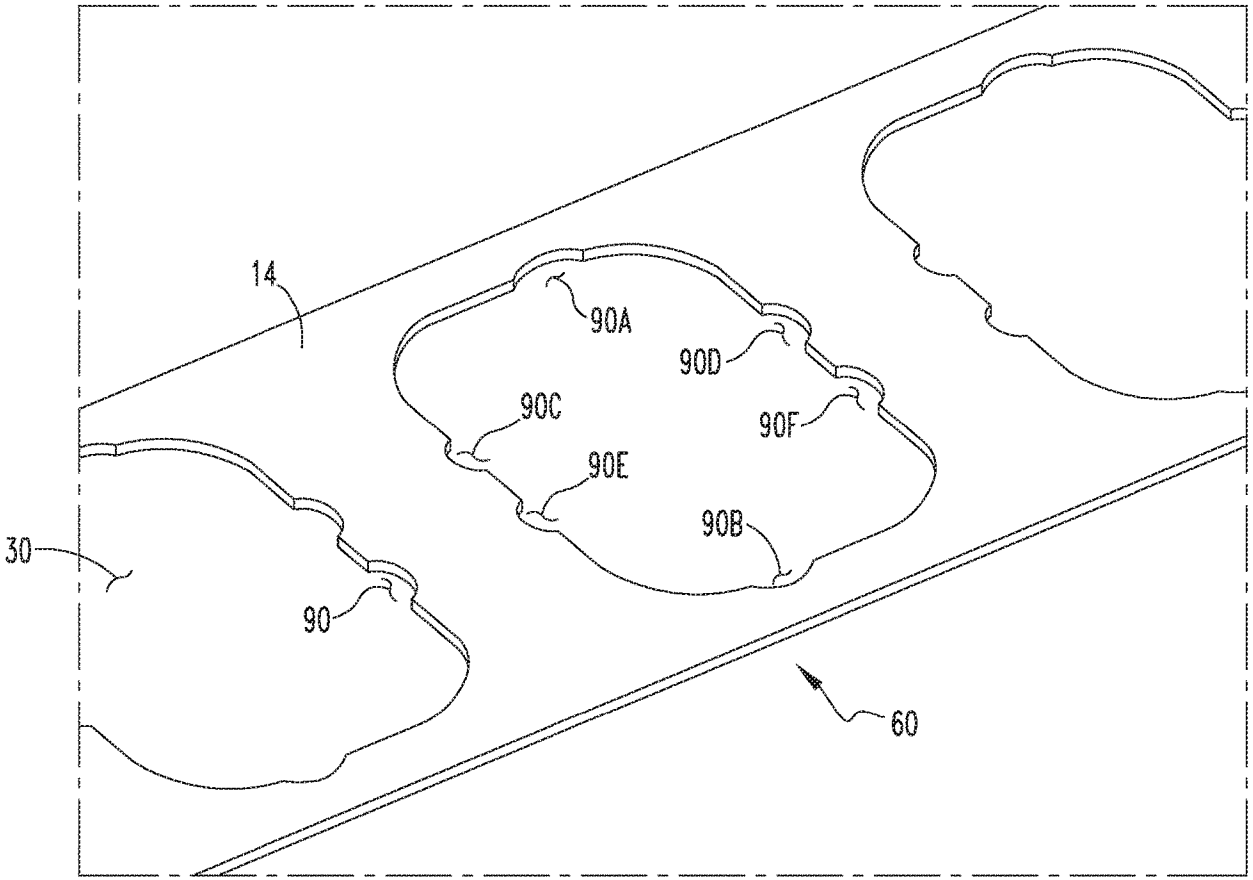
FIG. 4 is an isometric view of a transfer belt.
Figure 5:
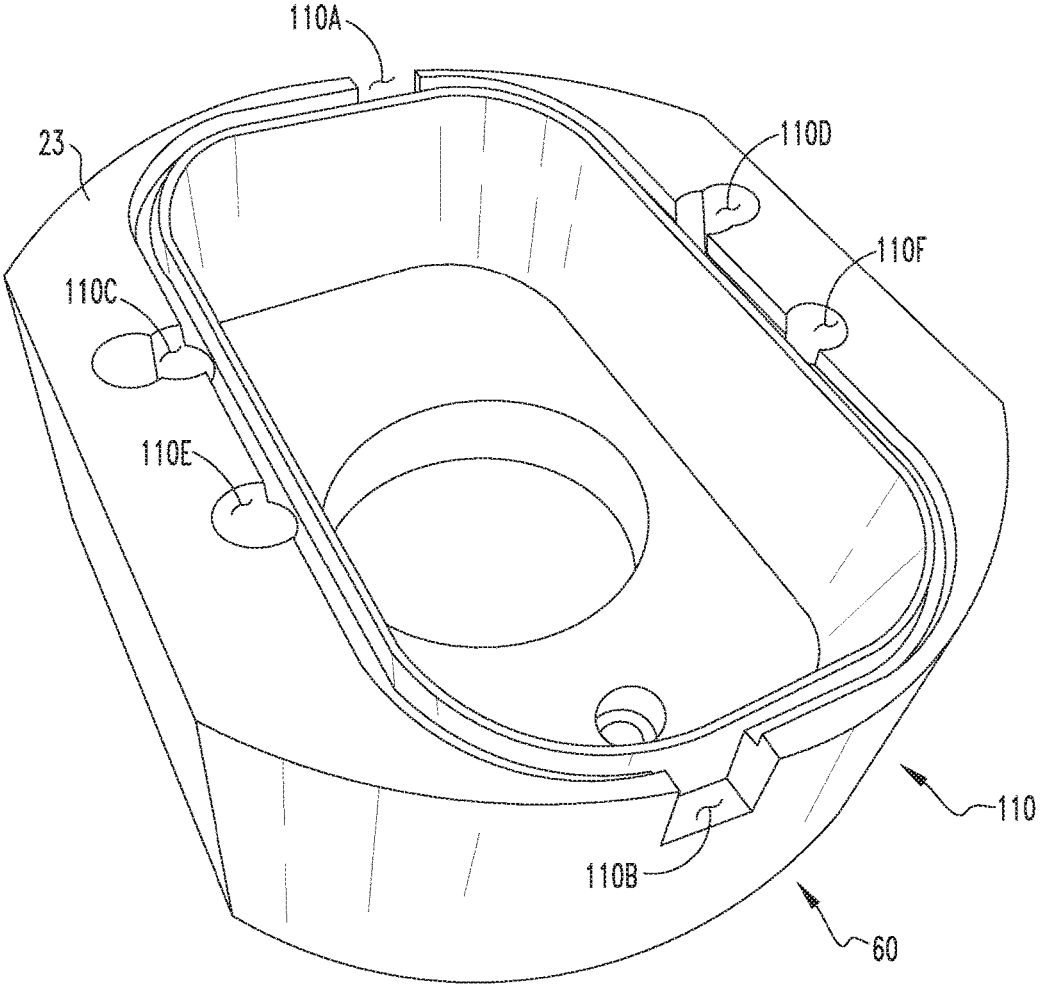
FIG. 5 is an isometric view of a lower forming construct.

As shown in FIG. 3, in an exemplary embodiment, the moving alignment elements 70 are elements coupled, directly coupled, or fixed to the upper tooling assembly 18. In this configuration, the moving alignment elements 70 move between a first position and a second position corresponding to the upper tooling assembly first position and a second position. As shown, the moving alignment elements 70 are elements coupled, directly coupled, or fixed to the upper forming construct 21 of the station, i.e., upper cap 22 as shown. In an exemplary embodiment, each moving alignment element 70 includes an elongated body 72 with a first end 74 and a second end 76. Each moving alignment element body first end 74 is structured to be coupled, directly coupled, or fixed to the upper tooling assembly 18. For example, each moving alignment element body first end 74 may define a passage (not shown) through which a coupling component, such as, but not limited to, a threaded fastener (not shown) may pass. It is understood that in such a configuration, the upper tooling assembly 18, or a component thereof such as, but not limited to, upper cap 22 would define a threaded bore (not shown) corresponding to the threaded fastener.

Figure 6:
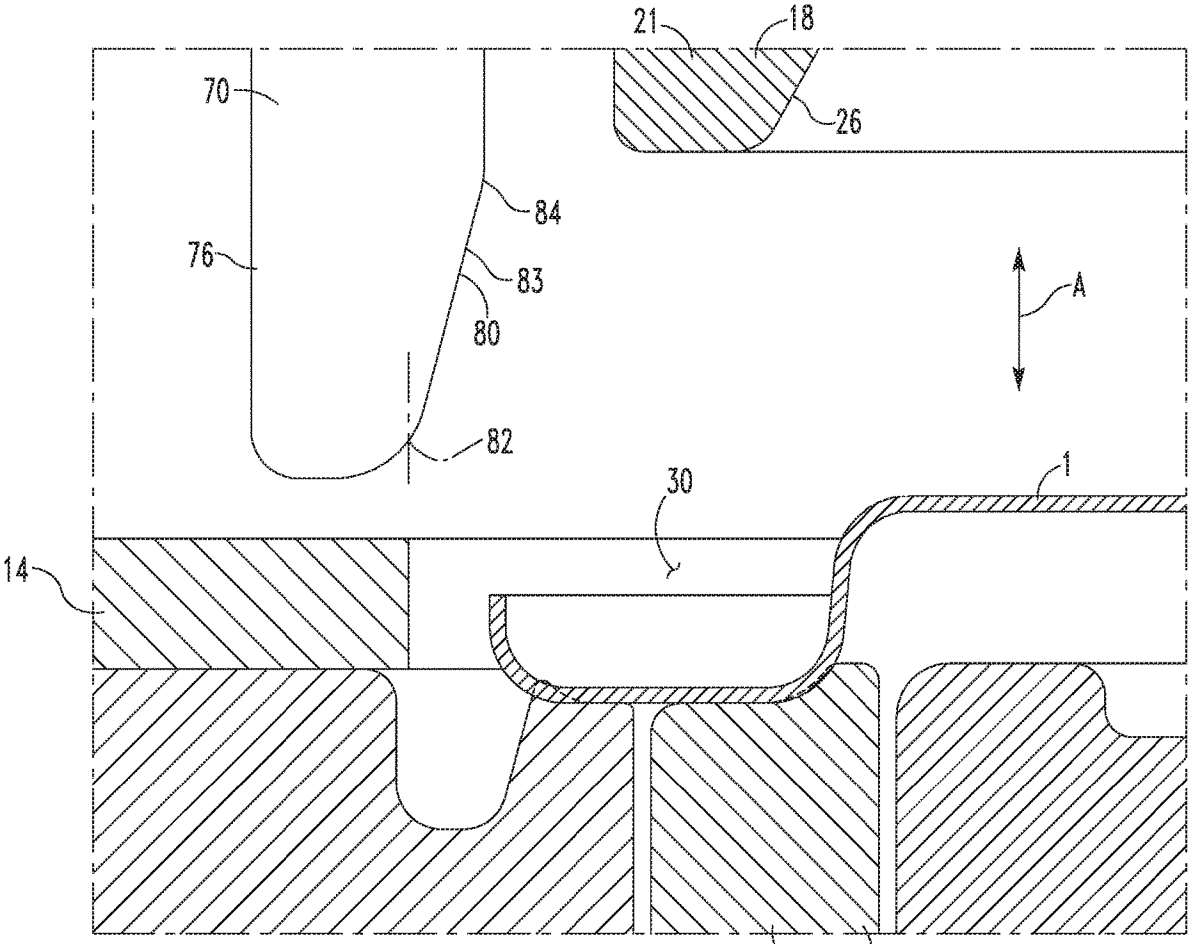
FIG. 6 is a cross-sectional, detail side view of an alignment assembly.

Each moving alignment element body second end 76, in an exemplary embodiment, includes an angled surface 80, as shown in FIG. 6. As used herein, an "angled surface" means angled relative to the path of motion (identified by arrow "A") of the moving tool assembly 18, 20. That is, in the exemplary embodiment discussed herein, the upper tool assembly 18 moves over a generally vertical path; thus, for the exemplary embodiment, the "angled surface" is at an angle relative to a generally vertical axis. Each moving alignment element body second end angled surface 80 faces a shell 1 when a shell 1 is in the initial alignment position for the associated station. Each moving alignment element body second end angled surface 80 has a lower end 82, a medial portion 83, and an upper end 84; hereinafter "angled surface lower end 82," "angled surface medial portion 83," and "angled surface upper end 84." Further, when a shell 1 is in the initial alignment position, at least one moving alignment element body second end angled surface 80 is disposed directly above the perimeter of the shell.

That is, in an exemplary embodiment, the number of moving alignment elements 70 includes a plurality of moving alignment elements 70. As shown in FIG. 2, the shell 1 is generally rectangular and includes lateral first and second sides 4, 5 (which extend generally parallel to each other and generally parallel to the transfer belt path of travel) and longitudinal third and fourth sides 6, 7 (which extend generally parallel to each other and generally perpendicular to the transfer belt path of travel). Thus, the shell 1 also includes a first axis 8 and a second axis 9. In this embodiment, the shell first axis 8 is generally parallel to the lateral first and second sides 4, 5 and the second axis 9 is generally parallel to the longitudinal third and fourth sides 6, 7.

In an exemplary embodiment, the plurality of moving alignment elements 70 includes a first moving alignment element 70A, a second moving alignment element 70B, a third moving alignment element 70C, a fourth moving alignment element 70D, a fifth moving alignment element 70E, and a sixth moving alignment element 70F. For descriptive purposes, and as used herein, the number of alignment elements 62, such as the number of moving alignment elements 70 described in this paragraph, are described in relation to a shell 1 as if the shell 1 were at the station of the tooling assembly 16 including the alignment assembly 60; it is understood that such a description is for reference only and that a shell 1 does not have to be in the press assembly 10 for the number of alignment elements 62 to be in the identified locations. The first moving alignment element 70A and the second moving alignment element 70B are disposed generally opposite each other and on opposite sides of the shell first axis 8. As shown, and as used herein, "generally opposite" does not require the elements to be directly opposite and the elements may be slightly offset from each other. Further, the third moving alignment element 70C and the fourth moving alignment element 70D are disposed generally opposite each other and on opposite sides of the shell second axis 9. Further, the fifth moving alignment element 70E and the sixth moving alignment element 70F are also disposed generally opposite each other and on opposite sides of the shell second axis 9. Moreover, the third moving alignment element 70C and the fifth moving alignment element 70E are disposed in an anti-twist configuration. Similarly, the fourth moving alignment element 70D and the sixth moving alignment element 70F are disposed in an anti-twist configuration. As used herein, an "anti-twist configuration" means that alignment elements are disposed on the same general side of a shell having a generally straight edge and which are spaced at least 0.5 inch apart.

In this configuration, and when a shell 1 is between the forming constructs having the alignment assembly 60, the moving alignment elements 70 are disposed on all sides of the generally rectangular shell of the present exemplary embodiment. Thus, as discussed above, when a shell 1 is in the initial alignment position, at least one moving alignment element body second end angled surface 80 is disposed directly above the perimeter of the shell 1.

The alignment recesses 90 are recesses disposed about the perimeter of each transfer belt aperture 30. As used herein, the alignment recesses 90 are not part of the perimeter of each transfer belt aperture 30; that is, the perimeter of each transfer belt aperture 30 is a substantially regular shape, e.g., circle, square, rectangle, obround, rounded square or rounded rectangle, and does not include the alignment recesses 90. Each alignment recess 90 is disposed in the path of an associated moving alignment element 70. Thus, in the exemplary embodiment described herein, there are a first alignment recess 90A, a second alignment recess 90B, a third alignment recess 90C, a fourth alignment recess 90D, a fifth alignment recess 90E, and a sixth alignment recess 90F. Each alignment recess 90 is structured to allow the associated moving alignment element 70 to pass through the transfer belt 14 as the upper tooling assembly moves into the second position. Further, each angled surface lower end 82 is disposed only over an alignment recess 90. That is, each angled surface lower end 82 path of travel extend only through an alignment recess 90. In this configuration, and when a shell's 1 initial alignment position positions the shell 1 against the perimeter of each transfer belt aperture 30, a moving alignment element 70 moving from the first position to the second position will not contact the shell 1. That is, the shell 1, even when partially formed will always stay within the perimeter of a transfer belt aperture 30. Thus, as the angled surface lower end 82 passes through an alignment recess 90, and as the alignment recess 90 is outside the perimeter of a transfer belt aperture 30, the angled surface lower end 82 path of travel will never be through a shell 1.

The number of alignment cavities 110 are cavities in the lower forming construct 23, in the exemplary embodiment, in die 24. Each alignment cavity 110 is disposed in the path of an associated moving alignment element 70. Thus, in the exemplary embodiment described herein, there are a first alignment cavity 110A, a second alignment cavity 110B, a third alignment cavity 110C, a fourth alignment cavity 110D, a fifth alignment cavity 110E, and a sixth alignment cavity 110F. Each alignment cavity 110 is sized and shaped to loosely correspond to the associated moving alignment element 70.

It is noted that, in an exemplary embodiment, each of the number of alignment elements 62 are disposed in positions corresponding to the moving alignment elements 70. That is, for a generally rectangular shell 1, there is a first alignment element 62A, a second alignment element 62B, a third alignment element 62C, a fourth alignment element 62D, a fifth alignment element 62E, and a sixth alignment element 62F. As noted above and for descriptive purposes, and as used herein, the number of alignment elements 62, such as the number of alignment elements 62 described in this paragraph, are described in relation to a shell 1 as if the shell 1 were at the station of the tooling assembly 16 including the alignment assembly 60; it is understood that such a description is for reference only and that a shell 1 does not have to be in the press assembly 10 for the number of alignment elements 62 to be in the identified locations. The first alignment element 62A and the second alignment element 62B are disposed generally opposite each other and on opposite sides of the shell first axis 8. Further, the third alignment element 62C and the fourth alignment element 62D are disposed generally opposite each other and on opposite sides of the shell second axis 9. Further, the fifth alignment element 62E and the sixth alignment element 62F are also disposed generally opposite each other and on opposite sides of the shell second axis 9.

In operation, as shown in FIGS. 7A-7D, the alignment assembly 60 operates as follows. It is understood that the press assembly 10 is in operation and the transfer belt 14 is indexing forward with shells 1 in different states of formation in each transfer belt aperture 30. As the transfer belt 14 indexes forward, the upper tooling assembly 18 starts to move from the first position to the second position. As the transfer belt 14 enters the stationary state of the indexing motion, the momentum of the shell 1 shifts the shell 1 forward in the transfer belt aperture 30. That is, the shell longitudinal third side 6 abuts the forward side of the transfer belt aperture 30. This is the initial alignment position of the shell 1.

Figure 7A:
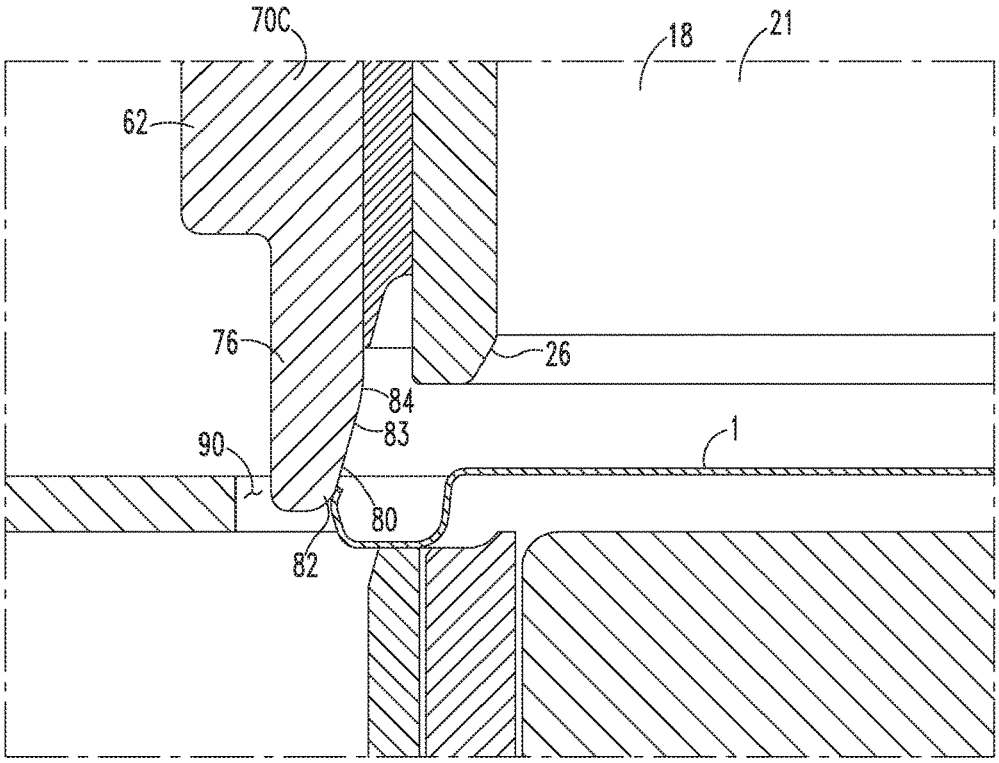
FIGS. 7A-7D show the alignment assembly moving a shell from the initial alignment position (FIG. 7A), to the intermediate alignment position (FIG. 7B), and to the final alignment position (FIG. 7C) as well as a forming operation (FIG. 7D).
Figure 7B:
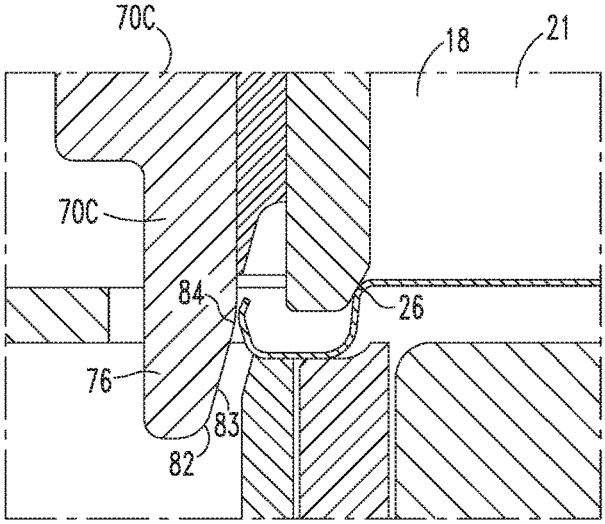
Figure 7C:
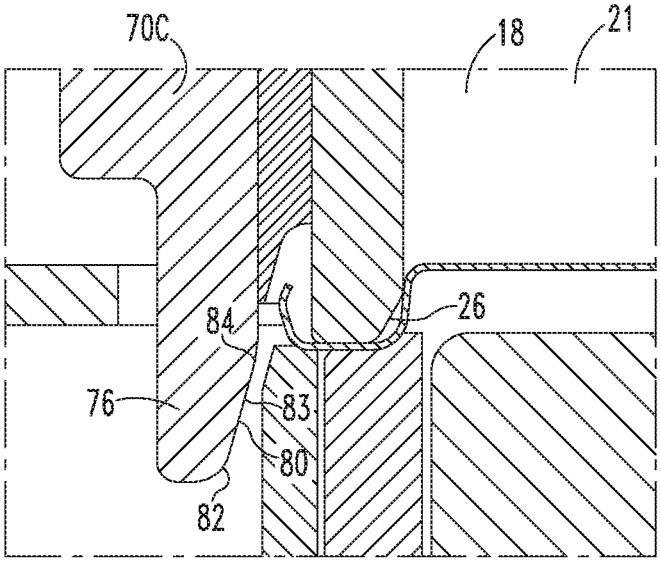
Figure 7D:
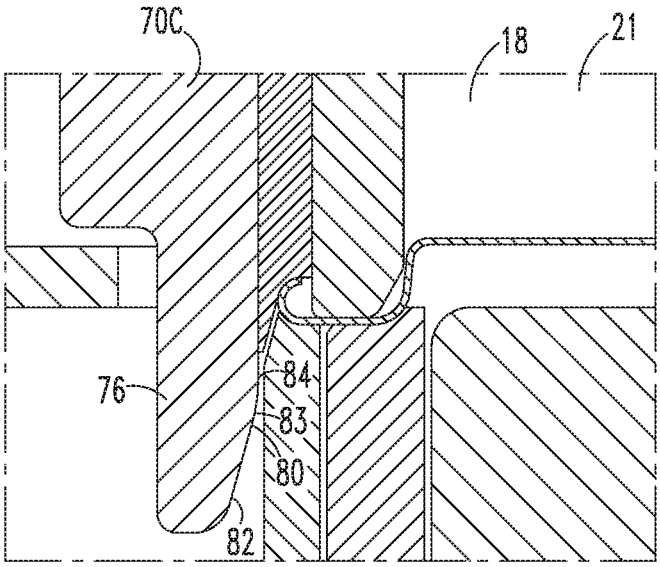

As the upper tooling assembly 18 moves into the second position, the angled surface lower end 82 of each moving alignment element 70 moves into an associated alignment recess 90, as shown in FIG. 7A. Further, downward motion of the upper tooling assembly causes the angled surface medial portion 83 of the third moving alignment element 70C and the fifth moving alignment element 70E to operatively engage the shell 1. As the angled surface medial portion 83 of the third moving alignment element 70C and the fifth moving alignment element 70E operatively engage the forward edge of the shell 1, i.e., as the upper tooling assembly 18 continues to move toward the second position, the shell 1 is moved rearwardly in the transfer belt aperture 30, as shown in FIG. 7B. As the angled surface upper end 84 passes the shell 1, the shell is in the intermediate alignment position. Continued motion of the upper tooling assembly 18 toward the second position brings the upper tooling assembly angled surface 26 into operative engagement with the shell 1 as shown in FIGS. 7B-7C. That is, the upper tooling assembly angled surface 26 operatively engages the shell 1 and moves the shell from the intermediate alignment position to the final alignment position, as shown in FIG. 7C. The shell is then in position to be formed, as shown in FIG. 7D.

In an exemplary embodiment, the upper tooling assembly angled surface 26 is at a first elevation. The angled surface lower end 82 is at a second elevation. The angled surface upper end 84 is at a third elevation. The third elevation generally corresponds to the first elevation. In this configuration, and with the motions described above, the shell is in the intermediate alignment position only for a moment. That is, the operative engagement of the shell 1, i.e., the movement of the shell 1, is substantially continuous.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An alignment assembly for a press assembly, said press assembly including an operating mechanism, a transfer belt and a tooling assembly, said tooling assembly including a upper tooling assembly and a lower tooling assembly, said upper tooling assembly moving between a first position, wherein said upper tooling assembly is spaced from said lower tooling assembly, and a second position, wherein said upper tooling assembly is immediately adjacent said lower tooling assembly, said transfer belt including a number of apertures, said apertures generally corresponding to a shell, said transfer belt movably disposed between said upper tooling assembly and said lower tooling assembly, said transfer belt indexing between said upper tooling assembly and said lower tooling assembly, wherein shells disposed in each transfer belt aperture index between said upper tooling assembly and said lower tooling assembly, said transfer belt positioning said shells in an initial alignment position when said transfer belt is not moving, said upper tooling assembly positioning said shells in a final alignment position as said upper tooling assembly moves from said first position to said second position, said alignment assembly comprising:

a number of alignment elements including a number of moving alignment elements;

said moving alignment elements coupled to said upper tooling assembly wherein said moving alignment elements move between a first position and a second position corresponding to said upper tooling assembly first position and a second position;

wherein said moving alignment elements are structured to move said shell from said initial alignment position to an intermediate alignment position; and wherein, as said upper tooling assembly moves from said first position to said second position, said moving alignment elements contact a shell and move said shell from said initial alignment position to an intermediate alignment position.

2. The alignment assembly of claim 1 wherein said shell includes a first axis and a second axis, wherein said shell first axis and said shell second axis are generally perpendicular to each other, and wherein:

said number of alignment elements includes a first alignment element and a second alignment element; and wherein said first alignment element and said second alignment element are disposed generally opposite each other and on opposite sides of one of said shell first axis or said shell second axis.

3. The alignment assembly of claim 2 wherein:

said number of alignment elements includes a third alignment element and a fourth alignment element; and wherein said third alignment element and said fourth alignment element are disposed generally opposite each other and on opposite sides of one of said shell first axis or said shell second axis.

4. The alignment assembly of claim 1 wherein said shell is generally planar and has a generally rectangular shape including a first side, a second side, a third side and a fourth side, said first side and said second side extending generally parallel to each other and generally parallel to the transfer belt path of travel, said third side and said fourth side extending generally parallel to each other and generally perpendicular to said first side, said shell further includes a first axis and a second axis, wherein said shell first axis extends generally parallel to the transfer belt path of travel and said second axis extends generally perpendicular to the transfer belt path of travel, and wherein:

said number of alignment elements includes a first alignment element, a second alignment element, a third alignment element and a fourth alignment element;

said first alignment element and said second alignment element are disposed generally opposite each other and on opposite sides of said shell first axis; and said third alignment element and said fourth alignment element are disposed generally opposite each other and on opposite sides of said shell second axis.

5. The alignment assembly of claim 4 wherein:

said number of alignment elements includes a fifth alignment element and a sixth alignment element;

said fifth alignment element and said sixth alignment element are disposed generally opposite each other and on opposite sides of said shell second axis;

said third alignment element and said fifth alignment element disposed in an anti-twist configuration; and said fourth alignment element and said sixth alignment element disposed in an anti-twist configuration.

6. The alignment assembly of claim 1 wherein:

each said moving alignment element includes an elongated body with a first end and a second end;

wherein each said moving alignment element body second end includes an angled surface; and each said moving alignment element body second end angled surface faces said shell when said shell is in said initial alignment position.

7. The alignment assembly of claim 6 wherein when a shell is in said initial alignment position, at least one moving alignment element body second end angled surface is disposed directly above the perimeter of the shell.

8. The alignment assembly of claim 6 wherein said upper tooling assembly includes an alignment surface structured to engage a shell and to move said shell from said intermediate alignment position to said final alignment position, said upper tooling assembly alignment surface disposed at a first elevation, and wherein:

each said moving alignment element body second end angled surface includes a lower end disposed at a second elevation, and, an upper end disposed at a third elevation; and wherein said third elevation generally corresponds to said first elevation.

9. The alignment assembly of claim 6 wherein:

said number of alignment elements include a number of alignment recesses disposed about the perimeter of each said belt aperture; and each said alignment recess disposed in the path of a moving alignment element when said shell is in said initial alignment position.

10. The alignment assembly of claim 6 wherein:

said number of alignment elements include a number of alignment cavities in said lower tooling assembly;

each said alignment cavity disposed in the path of a moving alignment element; and wherein, when said upper tooling assembly is in said second position, each said moving alignment element is disposed in an associated alignment cavity.

11. A press assembly comprising:

an operating mechanism;

a transfer belt;

a tooling assembly;

an alignment assembly;

said tooling assembly including a upper tooling assembly and a lower tooling assembly;

said operating mechanism operatively coupled to said tooling assembly and said transfer belt;

said upper tooling assembly moving between a first position, wherein said upper tooling assembly is spaced from said lower tooling assembly, and a second position, wherein said upper tooling assembly is immediately adjacent said lower tooling assembly;

said transfer belt including a number of apertures, said transfer belt apertures generally corresponding to a shell;

said transfer belt movably disposed between said upper tooling assembly and said lower tooling assembly, said transfer belt indexing between said upper tooling assembly and said lower tooling assembly, wherein shells disposed in each transfer belt aperture index between said upper tooling assembly and said lower tooling assembly;

said transfer belt positioning said shells in an initial alignment position when said transfer belt is not moving;

said alignment assembly including a number of alignment elements;

said number of alignment elements including a number of moving alignment elements;

said moving alignment elements coupled to said upper tooling assembly wherein said moving alignment elements move between a first position and a second position corresponding to said upper tooling assembly first position and a second position;

wherein said moving alignment elements are structured to move said shell from said initial alignment position to an intermediate alignment position; and wherein, as said upper tooling assembly moves from said first position to said second position, said moving alignment elements contact a shell and move said shell from said initial alignment position to an intermediate alignment position; and said upper tooling assembly positioning said shells in a final alignment position as said upper tooling assembly moves from said first position to said second position.

12. The press assembly of claim 11 wherein said shell includes a first axis and a second axis, wherein said shell first axis and said shell second axis are generally perpendicular to each other, and wherein:

said number of alignment elements includes a first alignment element and a second alignment element; and wherein said first alignment element and said second alignment element are disposed generally opposite each other and on opposite sides of one of said shell first axis or said shell second axis.

13. The press assembly of claim 12 wherein:

said number of alignment elements includes a third alignment element and a fourth alignment element; and wherein said third alignment element and said fourth alignment element are disposed generally opposite each other and on opposite sides of one of said shell first axis or said shell second axis.

14. The press assembly of claim 11 wherein said shell is generally planar and has a generally rectangular shape including a first side, a second side, a third side and a fourth side, said first side and said second side extending generally parallel to each other and generally parallel to the transfer belt path of travel, said third side and said fourth side extending generally parallel to each other and generally perpendicular to said first side, said shell further includes a first axis and a second axis, wherein said shell first axis extends generally parallel to the transfer belt path of travel and said second axis extends generally perpendicular to the transfer belt path of travel, and wherein:

said number of alignment elements includes a first alignment element, a second alignment element, a third alignment element and a fourth alignment element;

said first alignment element and said second alignment element are disposed generally opposite each other and on opposite sides of said shell first axis; and said third alignment element and said fourth alignment element are disposed generally opposite each other and on opposite sides of said shell second axis.

15. The press assembly of claim 14 wherein:

said number of alignment elements includes a fifth alignment element and a sixth alignment element;

said fifth alignment element and said sixth alignment element are disposed generally opposite each other and on opposite sides of said shell second axis;

said third alignment element and said fifth alignment element disposed in an anti-twist configuration; and said fourth alignment element and said sixth alignment element disposed in an anti-twist configuration.

16. The press assembly of claim 11 wherein:

each said moving alignment element includes an elongated body with a first end and a second end;

wherein each said moving alignment element body second end includes an angled surface; and each said moving alignment element body second end angled surface faces said shell when said shell is in said initial alignment position.

17. The press assembly of claim 16 wherein when a shell is in said initial alignment position, at least one moving alignment element body second end angled surface is disposed directly above the perimeter of the shell.

18. The press assembly of claim 16 wherein said upper tooling assembly includes an alignment surface structured to engage a shell and to move said shell from said intermediate alignment position to said final alignment position, said upper tooling assembly alignment surface disposed at a first elevation, and wherein:

each said moving alignment element body second end angled surface includes a lower end disposed at a second elevation, and, an upper end disposed at a third elevation; and wherein said third elevation generally corresponds to said first elevation.

19. The press assembly of claim 16 wherein:

said number of alignment elements include a number of alignment recesses disposed about the perimeter of each said belt aperture; and each said alignment recess disposed in the path of a moving alignment element when said shell is in said initial alignment position.

20. The press assembly of claim 16 wherein:

said number of alignment elements include a number of alignment cavities in said lower tooling assembly;

each said alignment cavity disposed in the path of a moving alignment element; and wherein, when said upper tooling assembly is in said second position, each said moving alignment element is disposed in an associated alignment cavity.

* * * * *